US005699669A

United States Patent [19]

Gebhard

[11] Patent Number: 5,699,669

[45] Date of Patent: Dec. 23, 1997

[54] AIR-CIRCULATING BASE FOR BOTTLED WATER COOLING AND DISPENSING APPARATUS

[76] Inventor: Albert W. Gebhard, 2101 E. Alameda Ave., Denver, Colo. 80209

[21] Appl. No.: 680,373

[22] Filed: Jul. 15, 1996

[51] Int. Cl.[6] ..... F25B 21/02

[52] U.S. Cl. ..... 62/3.64; 62/389; 222/146.6; 165/80.1; 165/47

[58] Field of Search ..... 62/3.64, 3.7, 3.2, 62/3.3, 3.6, 404, 406; 165/80.1, 47, 54; 222/146.1, 146.2, 146.6

[56] References Cited

U.S. PATENT DOCUMENTS

| | | | |
|---|---|---|---|
| 3,354,668 | 11/1967 | Gerny | 62/449 |
| 3,733,836 | 5/1973 | Corini | 62/3 |
| 4,745,759 | 5/1988 | Bauer et al. | 62/12 |
| 4,913,713 | 4/1990 | Beader et al. | 62/3.61 |
| 4,996,847 | 3/1991 | Zickler | 62/3.64 |
| 5,209,069 | 5/1993 | Newman | 62/3.64 |
| 5,367,879 | 11/1994 | Doke et al. | 62/3.6 |
| 5,421,159 | 6/1995 | Stokes | 62/3.64 |
| 5,469,708 | 11/1995 | Harrison et al. | 62/3.64 |

*Primary Examiner*—John M. Sollecito

[57] ABSTRACT

A water cooler and dispenser employs a ceramic crock containing a thermoelectric unit and an upwardly directed chilling probe extending into a chilling tank. The chilling probe is in heat-conducting relation to a heat sink, underneath which is a circulating fan. A circulating base is made up of a series of support fins arranged in a radial fashion in the bottom of the crock having a specialized arrangement of inlet and outlet ports. The air is circulated upwardly across the heat sink then circulated downwardly and expelled from the crock. In a conventional manner, water is drawn from the lower end of the chilling tank through a spigot extending to the exterior of the crock.

18 Claims, 2 Drawing Sheets

AIR-CIRCULATING BASE FOR BOTTLED WATER COOLING AND DISPENSING APPARATUS

BACKGROUND AND FIELD OF INVENTION

This invention relates generally to beverage coolers and dispensers, and more particularly relates to a water cooler and dispenser which employs a thermoelectric cooling system and a compact ventilating system for efficient circulation of air around a thermoelectric unit.

A variety of dispensing and cooling systems for bottled beverages have been devised to provide a means for efficiently cooling a relatively large amount of liquid in a compact area so that homes and offices might have a convenient and ready supply of cool drinking water available at the release of a spigot. For example, U.S. Pat. No. 4,996,847 to Zickler discloses a beverage cooler and dispenser which uses a thermoelectric unit, a heat sink, and a fan. The water to be cooled flows downwardly from the water container through a baffled compartment for discharge through a spigot. Newman, U.S. Pat. No. 5,209,069, discloses a beverage dispenser which is thermoelectrically cooled, the air being directed inwardly from the side and drawn over a heat sink with the aid of a fan mounted beneath the heat sink.

Thermoelectric cooling means have likewise been employed in devices other than beverage coolers. For instance, Bauer, et al., U.S. Pat. No. 4,745,759, recites a kidney preservation machine having a fan located under a heat sink, the warm air directed through a passageway assisted by fins. The air is drawn upwardly by the fan through the bottom of the heat exchange department and then discharged horizontally through a passageway. Corini, U.S. Pat. No. 3,733,836, describes a temperature-controlled mobile cart in which a fan forces air over heat sinks and inlet air is diverted from an outlet by louvers and passage ways. U.S. Pat. No. 3,354,668 to Serny, U.S. Pat. No. 4,913,713 to Bender, et al., and U.S. Pat. No. 5,367,879 to Doke, et al. are of general interest in showing the state of the art.

One problem often associated with thermoelectric cooling systems relates to the need for a relatively large surface area over which to conduct and transfer heat in order to achieve an efficient rate of cooling. Thus, a problem lies in devising an efficient cooling and ventilation system that will accommodate space and surface area limitations inherent in certain devices, such as a water cooler and dispenser, which ideally should be portable and compact.

The present invention solves this dilemma by providing a water cooler and dispenser in which the cooling unit and accompanying air-circulating base actually works most efficiently confined within the limited area of a housing. The design of the air-circulating base allows outside air to be efficiently drawn upwardly around a thermoelectric cooling unit, and the warmed air is circulated downwardly and out of the housing.

As will be described in detail below, the arrangement of inlet and outlet ports about the air-circulating base provides for a much more efficient exchange of air, and thus an improved and compact method of cooling bottled water.

Finally, the air-circulating base employed in the present invention is conformable for use with a variety of types of liquid or water coolers, and actually can be retrofitted to various kinds of standard water coolers.

SUMMARY OF THE INVENTION

It is therefore an object of the present invention to provide a water cooler which can operate most efficiently within a confined area and which does not require a great deal of surface area to achieve efficient cooling.

Another object of the present invention is to provide a water cooler equipped with an efficient ventilating system that will most effectively draw air into the cooler housing and expel warmed air through a specialized arrangement of inlet and outlet ports.

Yet another object of the present invention is to provide a water cooler wherein the ventilating system is disposed at the bottom portion of the housing in an underlying relationship to the cooling unit and heat sink elements.

In accordance with the present invention, a water cooler and dispenser utilizes a standard thermoelectric unit and a fan assembly in combination with an air-circulating base, which generally comprises a circular base plate having a number of ventilator fins arranged in radial fashion. Inlet ports are formed at diametrically opposed sides of the fins and serve to draw the outside air upwardly through and across the thermoelectric unit, with the assistance of the fan, and particularly across a heat sink toward the upper end of the thermoelectric unit. The warmed air is then circulated downwardly around the outside of the thermoelectric unit through a pair of outlet ports, each of which is displaced 90 degrees from a respective inlet port, and expelled from the apparatus by operation of the fan. Divider walls extending upwardly from the base plate effectively separate the inlet and outlet ports and also support the entire cooler unit. In a conventional manner, water is drawn from the lower end of the chilling tank through a spigot extending to the exterior of the crock.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
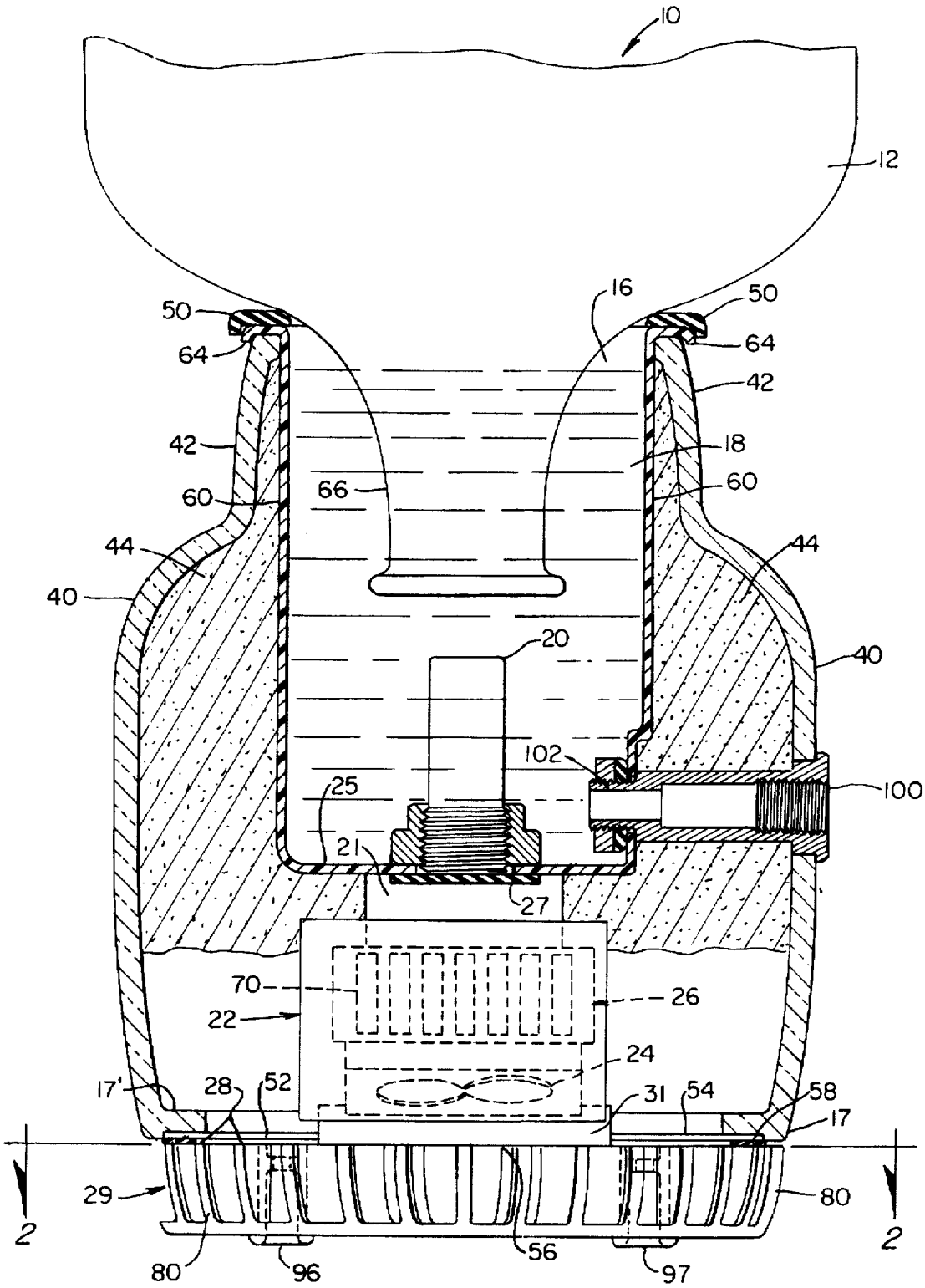
FIG. 1 is a longitudinal cross-sectional view illustrating the water cooler and dispensing system of the present invention.

Referring now to the drawings, wherein like referenced numerals designate corresponding structure throughout the views, and referring in particular to FIG. 1, the bottled water cooling and dispensing apparatus of the present invention 10 is intended for use with a standard five-gallon capacity bottle of drinking water 12, and includes a housing member 14, preferably a standard ceramic crock. The housing 14 has a recessed top portion 16 into which a plastic chilling tank 18 is fitted to conform to the configuration of the recessed portion 16, both of which are generally U-shaped in cross-section. An open, lower end 17 of the housing 14 has an outer surrounding rim 17'. A bottom wall 25 of the chilling tank 18 includes an opening through which an upwardly directed, elongated chill probe 20 is inserted and extended upwardly into the chilling tank 18.

A standard thermoelectric unit 22 is disposed directly beneath the chilling tank 18 to be described in more detail below. A fan 24 at the lower end of the thermoelectric unit 22 operates to draw outside air upwardly through the open, lower end 17 of the housing 14 and up and around the thermoelectric unit 22 in a manner to be described.

A bottom plate 28 is fitted into the housing's open lower end 17 and includes a plurality of openings, including a pair of diametrically opposed openings shown in FIG. 1 at 52, 54, through which the air is drawn upwardly and a central opening 56 through which air is expelled out by operation of the fan 24. A generally circular air-circulating base 29 is disposed beneath and affixed to the bottom plate 28. The air-circulating base 29 has a specialized arrangement of fins 80 and ports 30, 32, 34, 36, the circulation method and arrangement being described in detail below.

As FIG. 1 shows, the housing member 14 is generally cylindrical in configuration, having a generally cylindrical wall portion 40 which tapers into a neck portion 42 at the upper end of the housing 14. In its preferred form, the housing 14 is a ceramic crock of the type often used in water coolers and dispensers and includes a layer of insulating material 44, such as, polystyrene foam plastic, surrounding the chilling tank 18.

As shown in FIG. 1, the chilling tank 18, preferably made of plastic, is sized to fit into the recess 16 within the interior of the housing 14. The plastic chilling tank 18, also cylindrical in configuration, includes a pair of side walls 60, each of which terminates in a rim 64 at the top portion of the housing 14, and an annular cap 50 is surmounted on the rim 64. When a standard five-gallon bottle of water 12 is inverted into the housing 14, the neck of the water bottle 66 will extend downwardly into the chilling tank 18 and a volume of water will be released from the bottle 12 into the tank 18 where it is cooled by the thermoelectric unit 22.

Disposed directly beneath the chilling tank 18, the thermoelectric unit 22 is made up of the chilling probe 20, a thermoelectric chip 21, a heat sink 26, and a fan unit 24. One suitable type of unit 22 is a Peltier unit. As shown in FIG. 1, the chilling probe 20 extends upwardly through an opening 22 in the bottom wall 25 of the chilling tank 18 and extends into the volume of water held within the tank 18.

The lower end of the chilling probe 20 is in abutting, heat-conducting relation to the chip 21, and a standard gasket 27 is placed between the probe 20 and the chip 21 to prevent any leakage from the chilling tank 18. The chip 21 serves to conduct the heat drawn out of the water by the probe 20 and transfer it to the heat sink 26 disposed beneath the chip 21.

The heat sink 26 includes a plurality of fins 70 arranged about its periphery. The heat drawn from the water by the probe 20 is transferred via the chip 21 down to the heat sink 26 and is stored within the fins 70. The fan 24 beneath the heat sink 26 works in conjunction with the thermoelectric unit 22 and the underlying air-circulating base 29 in a manner to be described. A standard electric supply plug 95, disposed in an outer portion of the base 29, is connected to an external source.

The housing 14 has an open, lower end into which is fitted a complementarily sized circular bottom plate 28. The bottom plate 28 has a plurality of openings therethrough including the central, approximately square-shaped central opening 56 sized to fit around the similarly shaped fan unit 24. A gasket 31, placed around the lower end of the fan unit 24, serves as a seal between the bottom plate 28 and the fan unit 24 and assists in preventing air from entering or exiting through the central opening, thus directing it instead through the inlet or outlet ports 30, 32, 34 and 36. A gasket 58 is disposed in the plate 28 to effect sealed engagement with the lower open end 17 of the housing 14.

Figure 2:
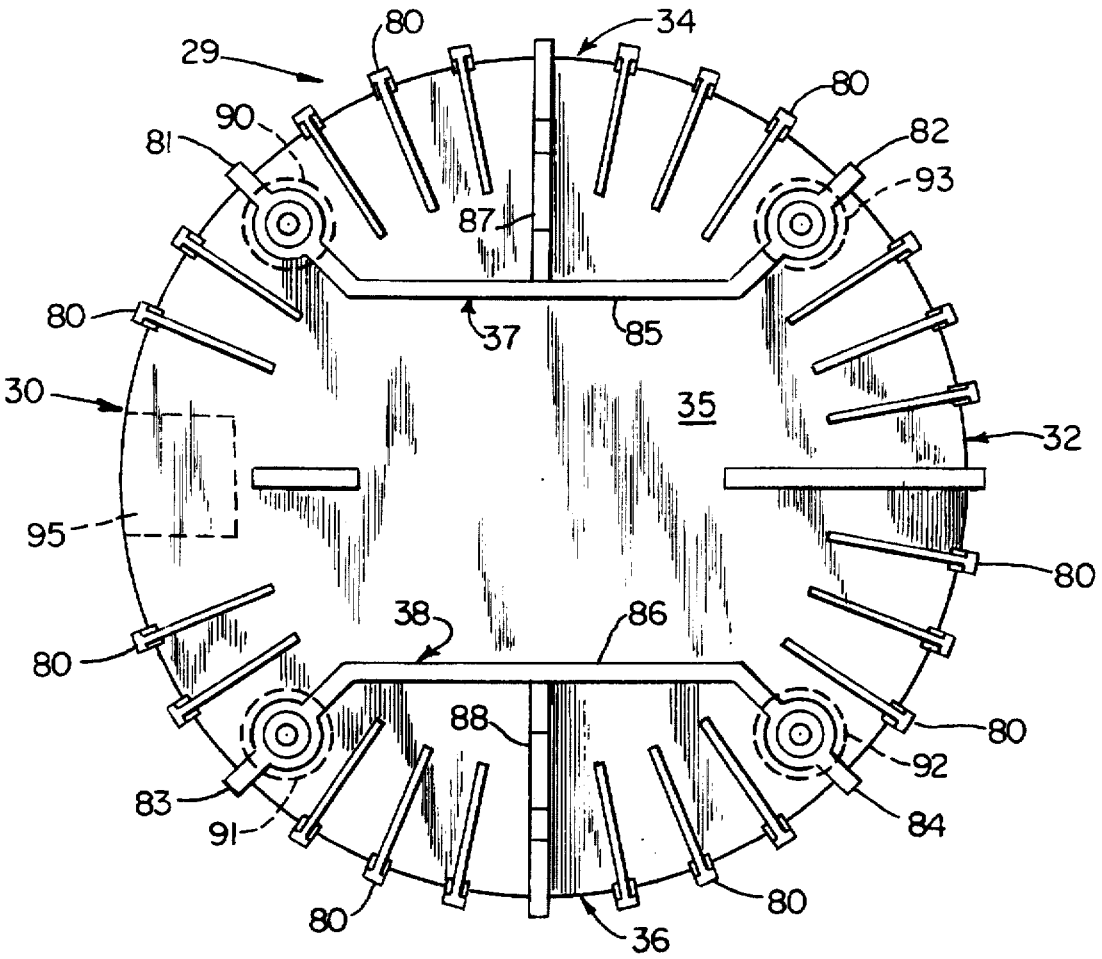
FIG. 2 is a top plan view of the base illustrating the fins and the inlet and outlet ports.

As shown in FIGS. 1 and 2, the air-circulating base 29 is disposed directly beneath the bottom plate 28 at the lowermost end of the housing 14 and is made up of a base plate 35 on whose upper, flat surface is arranged a plurality of radial fins 80 circumferentially spaced around the base plate 35 and extending upwardly from the base plate 35 to the bottom plate 28. The fins 80 support the entire unit above the base plate 35 while defining air passageways therebetween including a pair of diametrically opposed inlet ports 30, 32, to permit air to be drawn from outside of the housing 14 by action of the fan 24 and upwardly through the openings 52 and 54 towards the thermoelectric unit 22.

The fins also define a pair of diametrically opposed outlet ports 34, 36 which are displaced approximately 90 degrees from the inlet ports 30, 32 and serve as exit ways through which the air warmed within the interior of the housing 14 is expelled by the fan 24 through the central opening 56. When the base plate 35 is properly secured to the bottom plate 28 in the manner to be described, the inlet ports 30, 32, are aligned with the openings 52, 54 in the bottom plate 28 so that the air may be circulated up into the housing 14 and then expelled through the outlet ports 34, 36 and described. The outlet ports 34, 36 are further defined by divider walls 37, 38, respectively, which, as shown in FIG. 2 are of a generally widened U-shaped configuration with each free end 81, 82, 83, 84 of each respective divider wall 37, 38, respectively, disposed between a pair of the radial fins 80. The closed ends 85, 86 of each respective divider wall are generally parallel to one another in back-to-back relation on the base plate 35. A smaller center wall 87, 88 extends from each respective closed end portion 85, 86 towards the outer edge of the base plate 35, thus dividing each outlet port 34, 36 into two approximately equal portions.

In a manner similar to the radial fins 80, the various segments of the divider walls 37, 38 extend upwardly from the base plate 35 to the bottom plate 28, but are somewhat wider and thicker than the radial fins 80. As thus described, the divider walls 37, 38 effectively separate the outlet ports 34, 36, from the inlet ports 30, 32 and in cooperation with the solid portions of the plate 28 between the ports 52 and 54 serve to correctly direct the in-flowing and out-flowing air through the desired regions of the air-circulating base 29.

The base plate 35 is secured into the underside of the bottom plate 28 by a plurality of screws or bolts received through cylindrical housings 90, 91, 92, 93, extending upwardly through the bottom surface of the base plate 35 and upwardly from the upper surface of the base plate 35 to the same height as the divider walls 37, 38 and radial fins 80. When the housing 14, with the bottom plate 28 in place, is mounted on the base plate 35, the screws or bolts are then inserted upwardly through the cylindrical housings 90, 91, 92, 93 into openings in the lower surface of the bottom plate 28 thereby securing the base plate 35 to the bottom plate 28 and housing 14.

The bottom surface of the base plate 35 includes a plurality of circular, ridged feet 96, 97, which define the open ends of the cylindrical housings 90, 91, 92, 93 and which support the entire apparatus 10 when placed on a support surface.

In practice, the outside air surrounding the housing 14 enters through the inlet ports 30, 32 and is drawn upwardly through the openings 52, 54 by the action of the fan 24 around the upper end of the thermoelectric unit 22, in particular, and then passes downwardly toward and around the heat sink 26 where the heat absorbed by the probe 20 from the thermoelectric chip is stored. The air surrounding the thermoelectric unit 22 is thus warmed after passing over the heat sink 26 and picking up the heat stored therein. The operation of the fan 24 continues to circulate the air in a downward motion through the fan unit and central opening 56 such that the warm air is expelled from the housing 14 through the outlet ports 34, 36. The fins 80 and divider walls 37, 38 while working somewhat to direct the air flow through the air-circulating base, function as a base support for the housing 14, rather than an absorption or heat dissipating function. There may be applications wherein it is desirable to reverse the flow of air through the base by reversing the mounting of the fan 24 so that outside air is drawn through the ports 34, 36 upwardly through the central opening 56 and, after passing across the thermoelectric unit 22, is expelled through the ports 30, 32.

The arrangement of the cooling probe 20 and the other heat conducting and transferring elements in relation to the above-described air-circulating base 29 promotes increased efficiency in cooling because of the limited space within the interior of the housing. Foam insulating material 45 surrounds the chilling tank 18, while aiding the chilling tank 18 in keeping the water at a cool temperature, and serves to prevent the warmed circulating air from surrounding the chilling tank 18, at the same time directing the air downwardly and out of the housing 14.

The present invention includes a standard spigot assembly 100 for dispensing the cold water from the apparatus 10 and extends from an outside cylindrical wall 42 of the housing 14 through the foam insulating material 44 surrounding the chilling tank 18 through a side wall of the chilling tank 18, and into the interior of the chilling tank 18. Preferably, a gasket 102 is disposed at the juncture between the spigot assembly 80 and the chilling tank 18 to prevent water from leaking into the foam insulating material 44 and onto the other elements. In a conventional manner, water is then drawn from the lower end of the plastic chilling tank 18 through the spigot assembly 100.

It is therefore to be understood that while the preferred form of the invention is herein set forth and disclosed, various modifications and changes may be made therein without departing from the spirit and scope of the present invention as defined by the appended claims.

I claim:

1. In water cooling and dispensing apparatus having an insulated chilling tank, and an air circulating fan unit beneath said chilling tank, the improvement comprising:

an air-circulating base mounted beneath said apparatus having upper and lower generally circular mounting plates, a plurality of vertically extending fins arranged at circumferentially spaced intervals between said mounting plates, means connecting said mounting plates to said fins with said mounting plates disposed in horizontal, spaced parallel relation to one another and with passageways formed between said fins in communication with openings in said upper mounting plates, first and second dividing walls interposed between said plates in diametrically opposed relation to one another and separating said passageways into diametrically opposed inlet ports through which outside air can be drawn upwardly into said apparatus and diametrically opposed outlet ports displaced 90 degrees from said inlet ports through which air can be expelled from said apparatus.

2. In water cooling and dispensing apparatus having an insulated chilling tank, a thermoelectric unit and heat sink disposed beneath said chilling tank, and a fan unit disposed beneath said heat sink, the improvement comprising:

a generally circular air-circulating base disposed beneath said heat sink, said base comprising a first plate, at least one inlet port through which said outside air is drawn upwardly and across said heat sink by operation of said fan unit, thereby removing heat from said heat sink, at least one outlet port displaced 90 degrees from said inlet port through which said air is expelled from said apparatus by operation of said fan unit, first and second dividing walls extending upwardly from said plate and separating said inlet and said outlet ports, each of said walls defining one of said outlet ports, and a plurality of fins extending upwardly from said plate and spaced circumferentially across each of said inlet and said outlet ports, said fins defining a plurality of air-circulating passageways.

3. In apparatus according to claim 2, wherein said air-circulating base includes a second plate, said second plate disposed above said air circulating base and having a plurality of openings therethrough, said openings aligned with said inlet and said outlet ports.

4. In apparatus according to claim 3 wherein one of said openings is a central opening having a gasket placed therein thereby forming a seal between said bottom plate and said fan unit.

5. In apparatus according to claim 3 wherein said divider walls and said fins extend upwardly to said bottom plate thereby substantially supporting said apparatus.

6. In apparatus according to claim 2 wherein said inlet and outlet ports and said fins are radially arranged about the circumference of said base plate.

7. In apparatus according to claim 2 wherein said inlet ports are diametrically opposed from one another about said base plate.

8. In apparatus according to claim 2 wherein said outlet ports are diametrically opposed from one another about said base plate.

9. In apparatus according to claim 2 wherein each of said divider walls is generally U-shaped in configuration and has a greater thickness than that of each said fin.

10. In apparatus according to claim 3 wherein said base plate is secured to said bottom plate by a plurality of fasteners arranged about the outer circumference of said base plate.

11. In a water cooling and dispensing apparatus having an insulated chilling tank, and an air circulating fan unit beneath said chilling tank, the improvement comprising:

a circulating base having a generally circular plate, at least one inlet port through which outside air is drawn into said apparatus, at least one outlet port displaced 90 degrees from said inlet port through which said air is expelled from said apparatus, first and second dividing walls extending upwardly from said plate and separating said inlet and said outlet ports, and a plurality of fins extending upwardly from said plate and spaced circumferentially across each of said inlet and said outlet ports, said fins defining a plurality of air-circulation passageways, said apparatus supported on said fins and said dividing walls.

12. In apparatus according to claim 11 wherein said inlet and said outlet ports and said fins are radially arranged about the circumference of said base plate.

13. In apparatus according to claim 11 wherein said divider walls and said fins extend upwardly to a bottom plate in the lower end of said apparatus.

14. In apparatus according to claim 13 wherein said bottom plate has a plurality of openings therethrough, said openings aligned with said inlet and said outlet ports.

15. In apparatus according to claim 14 wherein one of said openings is a central opening having a gasket placed therein thereby forming a seal between said bottom plate and said fan unit disposed in the lower end of said apparatus.

16. In apparatus according to claim 11 wherein said inlet ports are diametrically opposed from one another about said base plate.

17. In apparatus according to claim 11 wherein said outlet ports are diametrically opposed from one another about said base plate.

18. In apparatus according to claim 11 wherein each of said divider walls is generally U-shaped in configuration and has a greater thickness than that of each said fin.

* * * * *